US005383570A

United States Patent [19]

Gordon

[11] Patent Number: 5,383,570

[45] Date of Patent: Jan. 24, 1995

[54] FLOOR MAT DISPENSING APPARATUS AND DISPOSABLE FLOOR MAT

[76] Inventor: Terry Gordon, 4716 N.W. 6th Court, Plantation, Fla. 33317

[21] Appl. No.: 100,484

[22] Filed: Jul. 30, 1993

[51] Int. Cl.[6] ..... A01C 9/00

[52] U.S. Cl. ..... 221/213; 221/232

[58] Field of Search ..... 221/213, 210, 214, 216, 221/259, 232, 279, 57, 59, 61, 281, 268, 276, 56; 271/18.3

[56] References Cited

U.S. PATENT DOCUMENTS

| | | | |
|---|---|---|---|
| 920,632 | 5/1909 | Oliver | 221/57 |
| 1,314,217 | 8/1919 | Roberts | 221/232 |
| 1,655,325 | 1/1928 | Mitchusson et al. | 221/213 |
| 2,858,045 | 10/1958 | Loeb | 221/59 |
| 3,767,083 | 10/1973 | Webb | 221/279 |
| 4,139,120 | 2/1979 | Moore | 221/213 |
| 4,319,695 | 3/1982 | Dutro | 221/213 |
| 4,508,238 | 4/1985 | Johnson et al. | 221/213 |
| 4,781,305 | 9/1988 | Carberry | 221/23 |
| 4,781,306 | 7/1988 | Smith | 221/33 |
| 4,789,079 | 12/1988 | Kobayashi et al. | 221/232 |
| 4,876,135 | 4/1989 | McIntosh | 428/74 |

FOREIGN PATENT DOCUMENTS

| | | | |
|---|---|---|---|
| 432089 | 9/1967 | Switzerland | 221/213 |

*Primary Examiner*—Kenneth W. Noland

*Attorney, Agent, or Firm*—Frank L. Kubler

[57] ABSTRACT

An apparatus for dispensing mats one at a time from a stack of mats, includes a mat retaining structure having a mat loading end and a mat dispensing end for retaining a stack of the mats, the mat within the structure nearest the dispensing end being designated the lead mat, the retaining structure including a mat dispensing slot disposed laterally of and adjacent to the lead mat near the mat dispensing end, a stop member for preventing the lead mat from advancing beyond the dispensing slot, a stack-biasing support member for biasing the stack of mats so that the lead mat bears against the stop member, a lead mat sliding assembly including a mat gripping member having a mat engaging surface and a guide member oriented substantially perpendicular to the dispensing slot for providing a surface along which the gripping member can ride, for guiding the gripping member over and spaced apart from the lead mat, and then toward and against the lead mat, dragging the lead mat along and pushing a portion of the lead mat through the dispensing slot to become accessible to an apparatus user. A disposable floor mat is also provided, including a paper sheet having a felt covering on one side for providing a slip-resistant surface for safe mat use and a paper surface on the other side, the covering being such that it does not bind with the paper surface of an abutting mat when in a stack inside a dispensing apparatus.

8 Claims, 4 Drawing Sheets

FLOOR MAT DISPENSING APPARATUS AND DISPOSABLE FLOOR MAT

BACKGROUND OF THE INVENTION

1. Field of the Invention

The present invention relates generally to the field of devices for dispensing flexible sheets, and more specifically to an apparatus for dispensing disposable floor mats one at a time from a stack of mats, the apparatus including a mat retaining structure having a mat loading end and a mat dispensing end for holding a stack of mats, the mat in the stack nearest the dispensing end being hereinafter designated as the lead mat, and having a dispensing slot disposed laterally of and adjacent to the lead mat at the mat dispensing end, and stop members for preventing the lead mat from advancing beyond the dispensing slot, and a removable spring-loaded stack support member at the mat loading end for continually biasing the stack so that the lead mat always bears against the stop members, and a lead mat sliding assembly including a gripping member having a high-friction mat engaging surface and a handle member, and guide members oriented substantially perpendicular to and on the dispensing end side of the dispensing slot, on which the gripping member rides, for guiding the gripping member as it advances toward the dispensing slot parallel to and spaced apart from the lead mat, and then toward and against the lead mat, and then directly toward the dispensing slot, pushing a portion of the lead mat through the dispensing slot to become accessible to the apparatus user, the stack support member then automatically biasing the next lead mat in the stack against the stop members and adjacent to the dispensing slot, the mats preferably being formed of paper with a felt-like covering on one side, the felt-like covering providing a non-slip surface for safe mat use, while not binding with the non-felt side of an abutting mat when on the stack inside the apparatus.

2. Description of the Prior Art

There have long been devices for dispensing flexible sheets from a stack of flexible sheets one at a time. These devices have taken the form of paper towel and napkin dispensers, and tissue paper boxes. Problems with these devices have included complexity and expense, unreliability and continual exposure of part of one sheet in a moisture-filled or contaminated environment. The latter are not well suited to use in bathrooms, whether in the home or in a hotel, because of high humidity generated by shower water.

Carberry, U.S. Pat. No. 4,781,305, issued in 1988, teaches a sheet paper dispenser device. The device includes a tray for holding a stack of paper. The tray has an open side for dispensing sheets and a flange at the forward edge to retard the movement of the sheets so that only one can advance at a time. A drive assembly on top of the tray includes four wheels which rest against the top sheet and are joined together by a drive chain, for advancing the top sheet through the open side. A problem with Carberry is that the sprocket, wheel and drive chain assembly is relatively complicated and expensive to manufacture.

Smith, U.S. Pat. No. 4,781,306, issued in 1988, reveals a stack of sheet material in a container with a top opening. Each sheet has along one edge a band of adhesive material to maintain the sheets in the stack. This arrangement is somewhat similar to that of U.S. Pat. No. 5,165,570, issued in 1992. This later patent discloses an apparatus for dispensing paper sheets from a stack, each sheet having a band of pressure sensitive adhesive on one surface adjacent an edge of the sheet. The dispenser arcs the stack and presses it toward the pressure sensitive portions and through a dispenser opening so that a user can grasp the top most sheet and pull it free. Removal of one sheet from the stack apparently pulls the next sheet into an accessible position. A problem with these designs is that a portion of the top sheet is always directly exposed. If the atmosphere is extremely humid, as in the case of a shower room, the paper may become soggy before it is used. This sogginess may also cause the sheet to tear apart rather than slide out of the dispenser.

U.S. Pat. No. 5,143,249, issued in 1992, discloses a stacked sanitary paper dispenser and a method for making the stack of paper. The stack consists of folded interleaving sheets forming a pile which is placed inside a cardboard sleeve which is open at both ends. The sleeve includes a first pair of opposite sides parallel and adjacent to the folding edges of the sheets and a second pair of sides parallel to the sheet surfaces and perpendicular to the first pair, and a sheet dispensing opening in at least one side. U.S. Pat. No. 5,135,179, issued in 1992, teaches an apparently similar sleeve dispenser structure for paper towels. A problem with these dispenser designs is that floor mats are heavier and generally larger than paper towels and sanitary paper sheets. Floor mats do not lend themselves as much to dispensing from a roll and should not be bent into the curve of a roll or sleeve, because they may tend to curl and spindle rather than lay flat on the floor.

U.S. Pat. No. 5,131,561, issued in 1992, reveals a napkin dispenser including a napkin housing with interchangeable face plates. A door is hinged to an opening in the housing and a face plate is detachably secured to the door. The napkins are dispensed through an opening in the face plate. The face plate can be changed to accommodate different types of napkins. The dispenser apparently depends on the friction of a napkin being pulled through the face plate opening dragging part of the next napkin through the opening. Once again, a problem is that part of a sheet item is always directly exposed to the atmosphere.

U.S. Pat. No. 5,114,774, issued in 1992, discloses an absorbent floor mat which is attachable to an existing floor with fastener means. A problem with this design is that the fastening means must be engaged and removed for each use, and must either be kept loose somewhere in the bathroom or somehow dispensed together with the mat.

U.S. Pat. No. 4,328,275, issued in 1982, reveals a disposable floor mat for bathrooms. The mat includes a sheet of liquid-absorbing matting with a multiplicity of raised portions and depressed portions distributed over the top of the matting. These raised portions are of substantially rigid and incompressible material for supporting the feet of a person and keeping the feet relatively dry. A problem with this design is that the raised portions make the mat relatively thick and abrasive. A relatively small number of these mats could be placed in a given dispenser, and the mats would tend to bind with each other against the independent lateral movement necessary for dispensing.

U.S. Pat. No. 4,644,592 discloses a disposable floor mat for use in an environment saturated with water. The mat has a sealant on one side to keep out moisture and a pressure sensitive adhesive on the other side to stick to a floor. A protective liner covers the adhesive, and is pealed away to expose the adhesive for use. A problem with this design is that the adhesive layer and protective liner make the mat relatively expensive to manufacture.

McIntosh, U.S. Pat. No. 4,876,135, issued in 1989, discloses a floor mat containing a disposable absorbent pad. This multilayered mat has a water-resistant, perforated top layer, an absorbent middle layer, and a water resistant bottom layer. The absorbent middle layer is intended to draw liquids and solids through the top layer perforations and out of contact with a user standing on the mat. A problem with McIntosh is that the multiple layers and perforations and edge sealing all make it relatively complicated and expensive to manufacture. Another problem is that the thickness of the triple-layered mat make it difficult or unsuitable for use in a dispenser apparatus.

It is thus an object of the present invention to provide a disposable floor mat dispenser apparatus which reliably dispenses one mat at a time from a stack of mats, and a mat which is suitable for use in the apparatus.

It is another object of the present invention to provide such an apparatus which is easy to load with mats.

It is still another object of the present invention to provide such an apparatus which keeps all the mats in the stack under cover until needed.

It is finally an object of the present invention to provide such an apparatus which is simple and inexpensive to manufacture.

SUMMARY OF THE INVENTION

The present invention accomplishes the above-stated objectives, as well as others, as may be determined by a fair reading and interpretation of the entire specification.

An apparatus is provided for dispensing mats one at a time from a stack of mats, including a mat retaining structure having a mat loading end and a mat dispensing end for retaining a stack of the mats, the mat within the structure nearest the dispensing end being designated the lead mat, the retaining structure including a mat dispensing slot disposed laterally of and adjacent to the lead mat near the mat dispensing end, a stop member for preventing the lead mat from advancing beyond the dispensing slot, a stack-biasing support member for biasing the stack of mats so that the lead mat bears against the stop member, a lead mat sliding assembly including a mat gripping member having a mat engaging surface and a guide member oriented substantially perpendicular to the dispensing slot for providing a surface along which the gripping member can ride, for guiding the gripping member over and spaced apart from the lead mat, and then toward and against the lead mat, dragging the lead mat along and pushing a portion of the lead mat through the dispensing slot to become accessible to an apparatus user. The retaining structure preferably includes a substantially rectangular housing including an interior and four walls extending around the perimeter of the stack of mats. The stop member is preferably a stop slat extending across the interior and between two of the walls of the housing substantially parallel to the slot. The removable stack support member is preferably a support plate extending across the loading end and mounted on a coil spring secured to one of the walls of the housing with a hooking clip. The gripping member preferably includes a laterally sliding rod extending substantially parallel to the dispensing slots, the sliding rod having a mat-engaging surface a flange, and a guide member in the form of an axially contoured guide rod oriented substantially perpendicular to and above the dispensing slot on which the laterally sliding rod rides. The apparatus also preferably includes a handle member extending into the retaining structure and engaging the sliding rod, for operating the sliding rod. The flange preferably includes several parallel ridges extending along its length for improved mat engagement.

A disposable floor mat is also provided, including a paper sheet having a felt covering on one side for providing a slip-resistant surface for safe mat use and a paper surface on the other side, the felt covering being such that it does not bind with the paper surface of an abutting mat when in a stack inside a dispensing apparatus.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
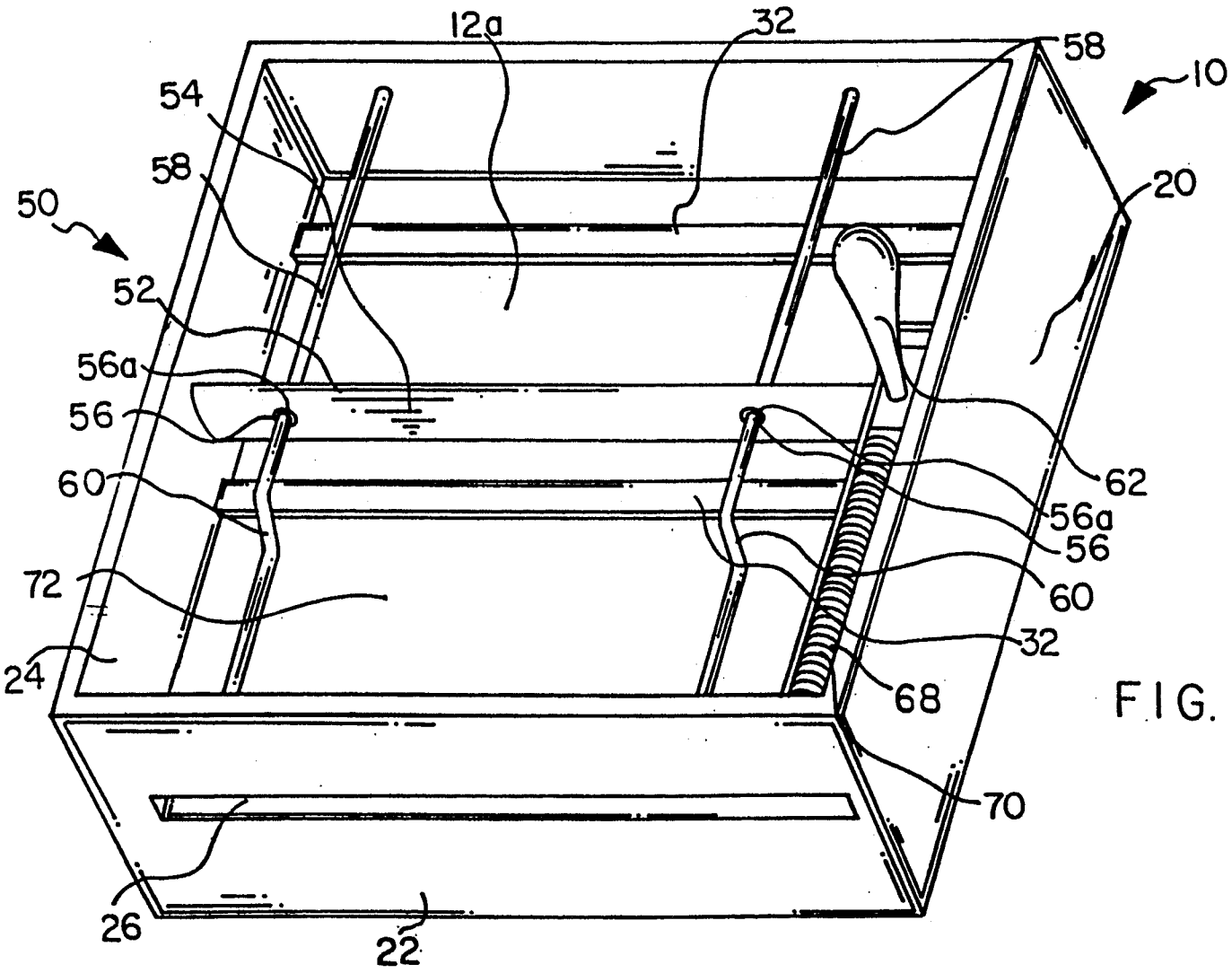
FIG. 1 is a perspective view of the preferred embodiment of the inventive apparatus with the dispensing end opened to reveal the lead mat, the stop slats, and the sliding assembly.
Figure 2:
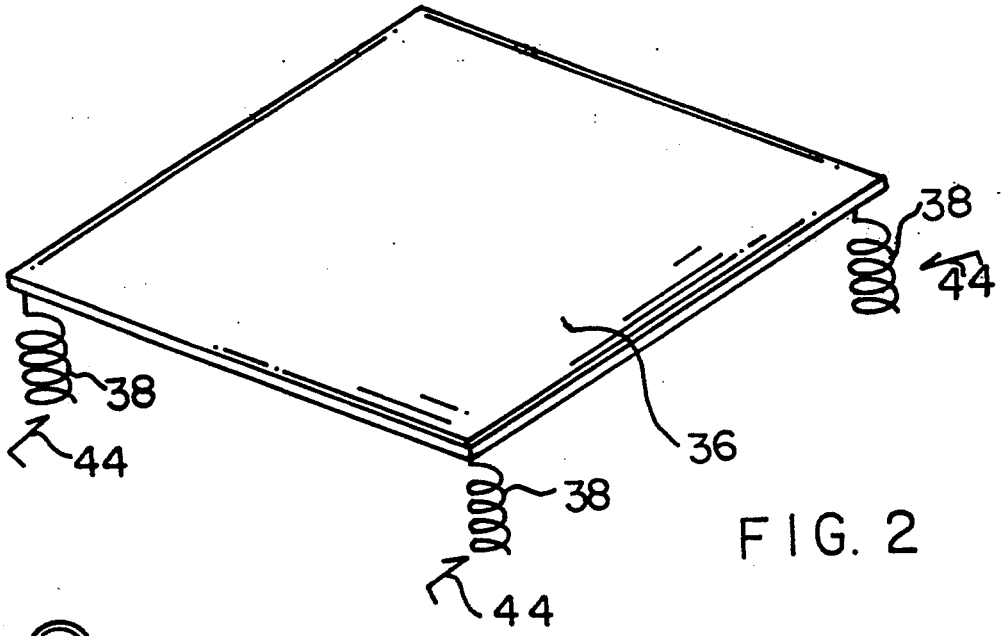
FIG. 2 is a perspective view of the support plate and springs at each corner (the spring at the rearmost corner is hidden from view), and the spring hooking clips.
Figure 3:
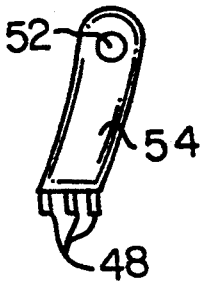
FIG. 3 is an end view of the sliding rod and mat engaging flange with three ridges on its engaging surface.
Figure 5:
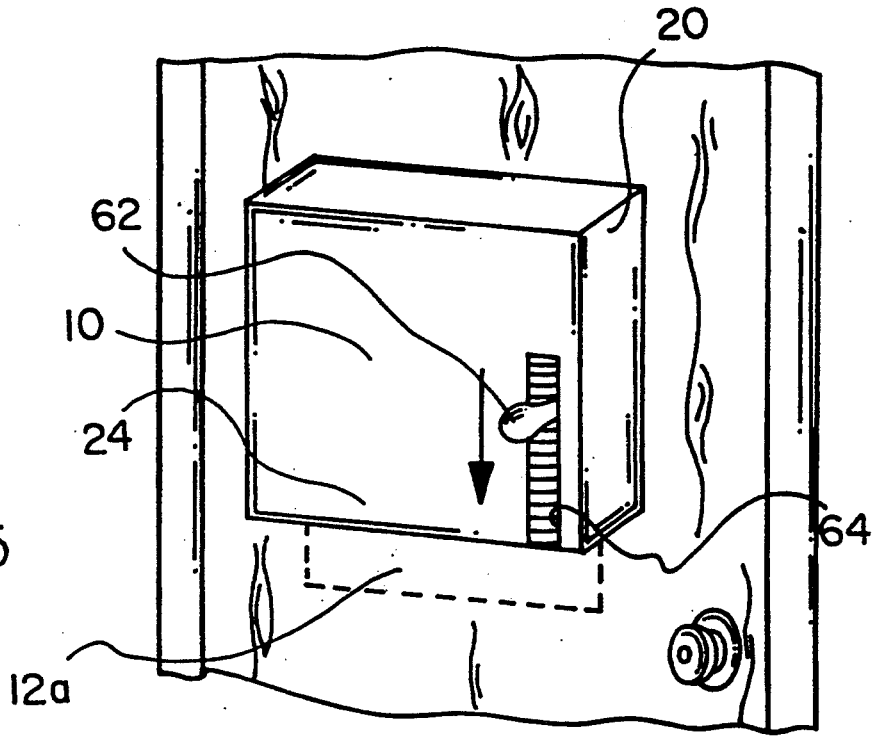
FIG. 5 is a perspective view of the inventive apparatus mounted on a door, the direction of handle pulling by a user indicated with an arrow and an exposed mat indicated in broken lines.
Figure 4:
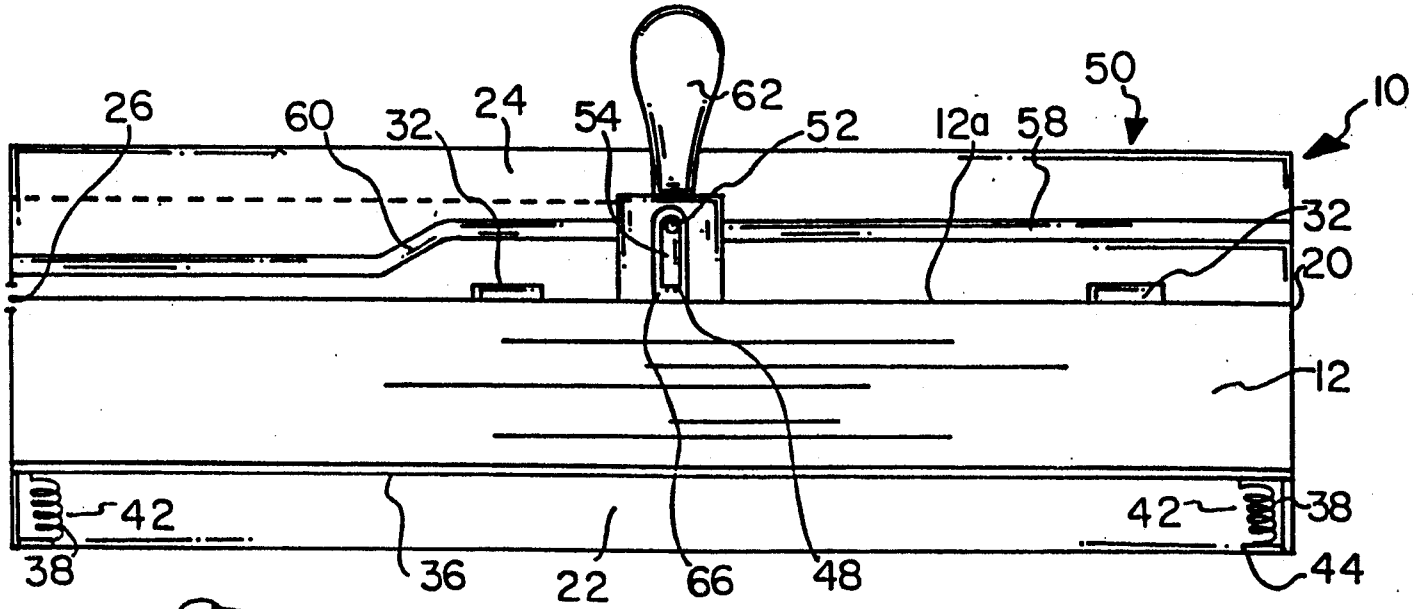
FIG. 4 is a cross-sectional side view of the inventive apparatus of FIG. 1, with the handle spring and spring box removed to reveal a guide rod rounded step.
Figure 6:
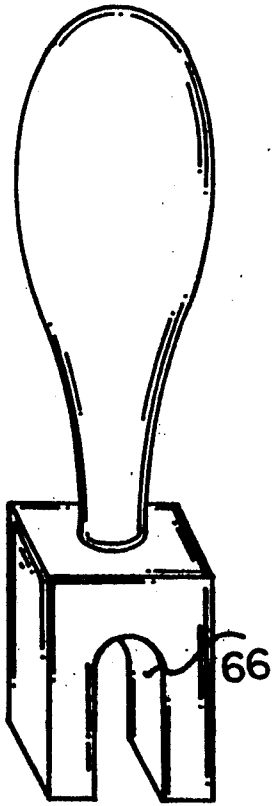
FIG. 6 is a perspective view of the inventive handle member with the slot in its sliding rod engaging end.
Figure 7:
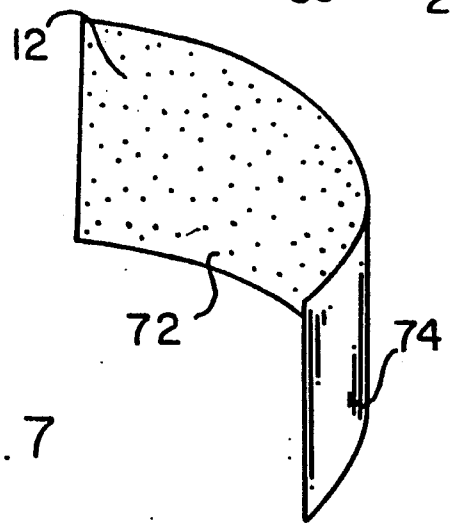
FIG. 7 is a perspective view of the inventive floor mat, showing both the felt side and the paper side.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various Figures are designated by the same reference numerals.

FIRST PREFERRED EMBODIMENT

Referring to FIGS. 1–7, an apparatus 10 is disclosed for dispensing flexible sheets of material one at a time from a stack of sheets, and specifically for dispensing specially adapted disposable floor mats 12. Apparatus 10 includes a retaining structure in the form of a rectangular housing 20 having a mat loading end 22 and a mat dispensing end 24 for holding a stack of mats 12. See FIG. 1. The mat 12 nearest the dispensing end 24 is hereinafter referred to as the lead mat 12*a*. Housing 20 has a mat dispensing slot 26 disposed laterally of and adjacent to an edge of lead mat 12*a* at dispensing end 24. Stop members are provided in the form of resilient stop slats 32 attached at either end to housing 20, for preventing lead mat 12*a* from moving beyond dispensing slot 26.

A removable stack support member is provided in the form of a support plate 36 extending across loading end 22 and mounted at each corner on a coil spring 38. See FIGS. 1, 2 and 3. Each coil spring 38 is removably anchored into a recess 42 in a wall of housing 20 with a hooking clip 44. Support plate 36 continually biases the stack so that lead mat 12*a* always bears against stop slats 32.

A lead mat sliding assembly 50 includes a mat gripping member in the form of a laterally sliding rod 52 extending substantially parallel to dispensing slot 26. See FIGS. 1 and 3. Sliding rod 52 has a high-friction mat-engaging surface in the form of a rubber flange 54. Flange 54 preferably has three parallel ridges 48 extending along its engaging edge for improved mat 12*a* engagement. See FIG. 3. Assembly 50 also includes guide members in the form of contoured guide rods 58 oriented substantially perpendicular to and above dispensing slot 26. Guide rods 52 extend through slide ports 56 in flange 54, and are surrounded by bushings 56*a* to reduce friction so that sliding rod 52 slides easily along guide rods 58. Guide rods 58 are bent to laterally guide sliding rod 52 as sliding rod 52 moves toward and away from dispensing slot 26. As sliding rod 52 moves toward dispensing slot 26, it advances parallel to and spaced apart from lead mat 12*a*, and then toward and against lead mat 12*a*, and then parallel to and against lead mat 12*a*. To create this guide path, guide rods 58 each have a rounded step portion 60 or jog bent into their mid-sections. See FIGS. 1 and 4. In this way, sliding rod 52 engages lead mat 12*a*, and then drags lead mat a along with it, pushing a portion of lead mat 12*a* through dispensing slot 26. This portion of lead mat 12*a* thereby becomes accessible to the apparatus user for removal of lead mat 12*a*. See FIG. 5. Stack support plate 36 then automatically biases the next lead mat 12*a* against stop slats 32 and adjacent to dispensing slot 26.

Figure 8:
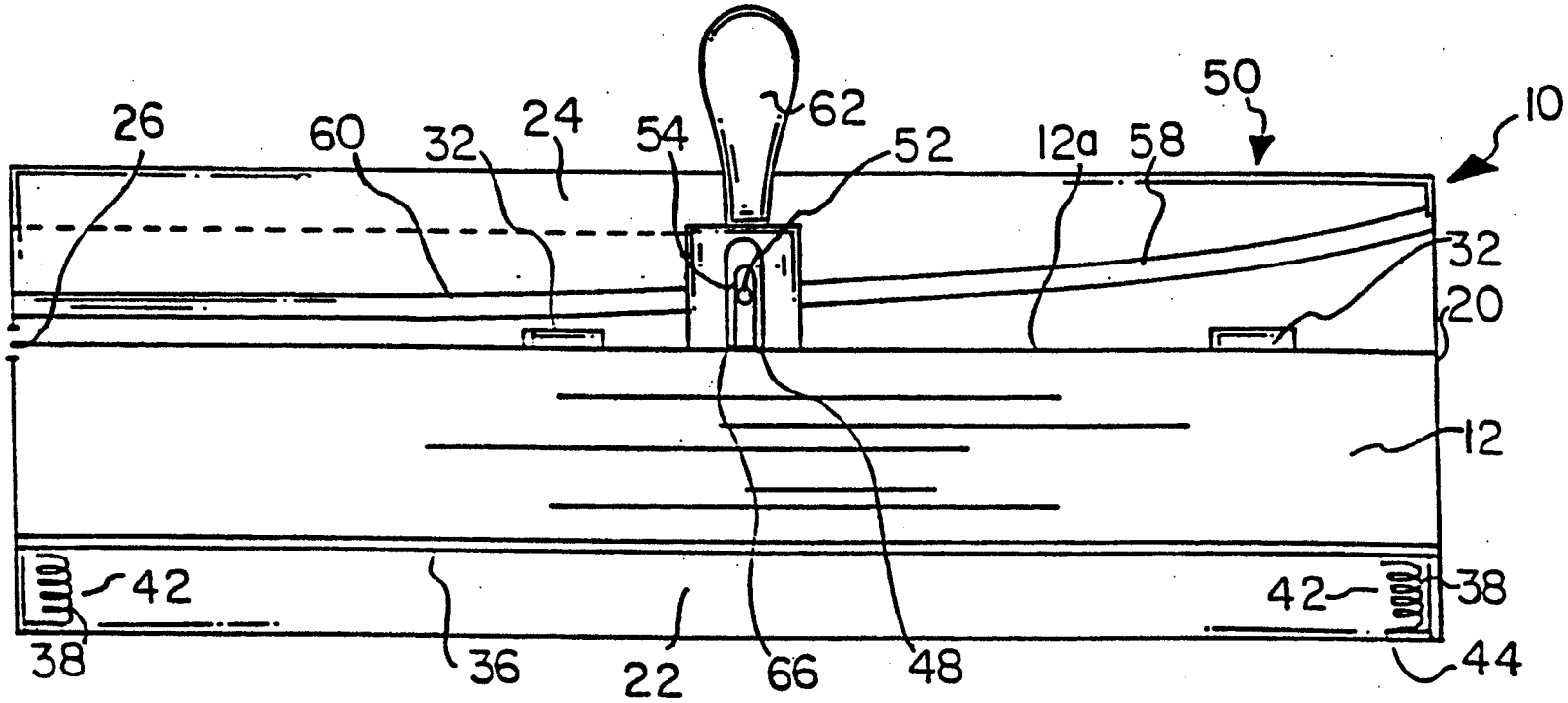
FIG. 8 is a view as in FIG. 4 showing the alternative parabolic guide rods.

Guide rods 58 are alternatively bent parbolically so that sliding rod 52 advances rapidly toward and against mat 12*a*, and then progresses into a path approaching parallel with mat 12*a*. See FIG. 8.

A handle 62 is preferably provided on sliding rod 52, extending perpendicularly through a slot 64 in dispensing end 24. See FIG. 6. Handle 62 has a channel 66 in its rod 52 engaging end within which sliding rod 52 laterally slides when moving on the rounded step portion 60 of guide rods 58. A handle spring 68 contained within a spring box 70 biases handle 62 to a position away from dispensing slot 26.

A stack of mats 12 is loaded into housing 20 by disengaging hooking clips 44 and removing springs 38. See FIGS. 2 and 4. Then support plate 36 is lifted out of loading end 22 of housing 20 and a stack of mats 12 inserted into loading end 22. Then support plate 36 is again inserted into loading end 22 behind mats 12. Springs 38 are reinserted and secured into recesses 42 with hooking clips 44.

Floor mats 12 are each preferably formed of paper with a felt-like covering 72 on one side and exposed paper 74 on the other side. See FIG. 7. The felt-like covering 72 provides a non-slip or equivalently slip resistant surface for safe mat use 12 on a floor. The felt-like covering 72 does not bind against the exposed paper 74 of another mat 12, so that mat 12*a* slides easily off an adjacent mat 12 during dispensing.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for dispensing mats one at a time from a stack of mats, comprising:

a mat retaining structure having a mat loading end and a mat dispensing end for retaining a stack of said mats, said mats being substantially mutually parallel, the mat within said structure nearest said dispensing end being designated the lead mat, said retaining structure comprising a mat dispensing slot disposed laterally of and adjacent to said lead mat near said mat dispensing end, a stop member for preventing said lead mat from advancing beyond said dispensing slot, a stack-biasing support member for biasing said stack of said mats such that said lead mat bears against said stop member, a lead mat sliding assembly comprising a mat gripping member laving a mat engaging surface and a guide member having a first end segment spaced apart from said mats, an intermediate segment oriented generally toward said mats, and a second end segment oriented substantially parallel to said mats and secured adjacent to said dispensing slot for providing a surface along which said gripping member can ride such that said first end segment guides said gripping member over and spaced apart from said lead mat, and then said intermediate segment guides said gripping member toward and against said lead mat, and then said second end segment guides said gripping member substantially parallel to said mats dragging said lead mat along and pushing a portion of said lead mat through said dispensing slot to become accessible to an apparatus user.

2. The apparatus of claim 1, wherein said retaining structure comprises a substantially rectangular housing comprising an interior and four walls extending around the perimeter of said stack of said mats.

3. The apparatus of claim 2, wherein said stop member is a stop slat extending across said interior and between two of said walls of said housing substantially parallel to said slot.

4. The apparatus of claim 2, wherein said removable stack support member is a support plate extending across said loading end and mounted on a coil spring secured to one of said walls of said housing with a hooking clip.

5. The apparatus of claim 1, wherein said gripping member comprises:

a laterally sliding rod extending substantially parallel to said dispensing slot, said sliding rod having a mat-engaging surface flange, a guide member in the form of an axially contoured guide rod oriented substantially perpendicular to and above said dispensing slot on which said laterally sliding rod rides.

6. The apparatus of claim 5, additionally comprising:

a handle member extending into said retaining structure and engaging said sliding rod, for operating said sliding rod.

7. The apparatus of claim 5, wherein said flange comprises a plurality of parallel ridges extending along its length for improved mat engagement.

8. An apparatus for dispensing mats one at a time from a stack of mats, comprising:

a mat retaining structure having a mat loading end and a mat dispensing end for retaining a stack of said mats, said mats being substantially mutually parallel, the mat within said structure nearest said dispensing end being designated the lead mat, said retaining structure Comprising a mat dispensing slot disposed laterally of and adjacent to said lead mat near said mat dispensing end, a stop member for preventing said lead mat from advancing beyond said dispensing slot, a stack-biasing support member for biasing said stack of said mats such that said lead mat bears against said stop member, a lead mat sliding assembly comprising a mat gripping member having a mat engaging surface and a guide member having a first end segment oriented generally toward said mats and a second end segment oriented substantially parallel to said mats and secured adjacent to said dispensing slot for providing a surface along which said gripping member can ride such that said first end segment guides said gripping member toward and against said lead mat and then said second end segment guides said gripping member substantially parallel to .said mats dragging said lead mat along and pushing a portion of said lead mat through said dispensing slot to become accessible to an apparatus user.

* * * * *